US007665810B2

(12) United States Patent
Crompton et al.

(10) Patent No.: US 7,665,810 B2
(45) Date of Patent: Feb. 23, 2010

(54) KITCHEN APPLIANCE HAVING A FLOATING GLASS PANEL

(75) Inventors: Edward Crompton, Iowa City, NE (US); John Phillip Myers, Manitowoc, WI (US)

(73) Assignee: Maytag Corporation, Benton Harbor, MI (US)

( * ) Notice: Subject to any disclaimer, the term of this patent is extended or adjusted under 35 U.S.C. 154(b) by 323 days.

(21) Appl. No.: 11/783,521

(22) Filed: Apr. 10, 2007

(65) Prior Publication Data

US 2008/0252186 A1 Oct. 16, 2008

(51) Int. Cl.
*A47G 29/00* (2006.01)

(52) U.S. Cl. ..... 312/204; 312/265.6

(58) Field of Classification Search ..... 312/204, 312/265.6, 265.5, 326–329, 226, 227, 405; 49/501; 40/760; 52/511, 508
See application file for complete search history.

(56) References Cited

U.S. PATENT DOCUMENTS

| | | | | |
|---|---|---|---|---|
| 1,718,026 | A * | 6/1929 | Blackman | 312/227 |
| 1,797,496 | A * | 3/1931 | Clark | 312/140.3 |
| 1,802,552 | A * | 4/1931 | Corcoran | 292/166 |
| 2,402,717 | A * | 6/1946 | Winer | 428/83 |
| 2,973,235 | A | 2/1961 | Saunders | |
| 3,501,186 | A * | 3/1970 | Trump et al. | 52/718.05 |
| 3,631,630 | A | 1/1972 | Buffington et al. | |
| 4,229,921 | A | 10/1980 | Schell | |
| 4,732,431 | A | 3/1988 | Mason | |
| 4,744,189 | A * | 5/1988 | Wilson | 52/511 |
| 5,358,326 | A | 10/1994 | Cherry et al. | |
| 5,564,808 | A * | 10/1996 | Gipson et al. | 312/405 |
| 5,806,942 | A | 9/1998 | Jenkins, Jr. et al. | |
| 6,408,841 | B1 | 6/2002 | Hirath et al. | |
| 6,854,458 | B2 | 2/2005 | Herzer | |
| 6,997,530 | B2 | 2/2006 | Avendano et al. | |
| 7,529,082 | B2 * | 5/2009 | Maruta | 312/7.2 |
| 2004/0183413 | A1 | 9/2004 | Koo | |
| 2004/0222725 | A1 * | 11/2004 | Park et al. | 312/405 |
| 2007/0188059 | A1 * | 8/2007 | Davis et al. | 312/265.6 |
| 2009/0045705 | A1 * | 2/2009 | Laible et al. | 312/204 |

FOREIGN PATENT DOCUMENTS

| | | |
|---|---|---|
| GB | 2186311 | 8/1987 |

* cited by examiner

*Primary Examiner*—Janet M Wilkens
(74) *Attorney, Agent, or Firm*—Kirk W. Goodwin; John W. Morrison; Diederiks & Whitelaw PLC

(57) ABSTRACT

A glass panel assembly for kitchen appliances includes a glass panel and a plurality of spacers. The spacers are mounted to an outer surface of the appliance and an inner surface of the glass panel. Preferably, the spacers are adhesively secured to the glass panel and are not visible when viewing the kitchen appliance from the front. Trim pieces fit between the glass panel and the appliance door to cover and further hide the spacers from view. The glass panel can be mounted to any outer surface of the appliance such as an appliance door, side walls or even a top wall. The particular construction of the spacers, in combination with the trim pieces creates an illusion that glass panel appears to float relative to the appliance.

20 Claims, 4 Drawing Sheets

KITCHEN APPLIANCE HAVING A FLOATING GLASS PANEL

BACKGROUND OF THE INVENTION

1. Field of the Invention

The present invention pertains to the art of kitchen appliances and, more particularly, to providing a kitchen appliance with one or more decorative glass panels.

2. Discussion of the Prior Art

Attaching a decorative façade to kitchen appliances is well known in the art. The decorative façade allows the appliance to "tie-in" to overall kitchen décor. The decorative façade can take on a variety of forms from something as simple as a coat of paint to made-to-order wooden panels that match adjacent cabinetry. In many cases, the decorative panel takes the form of a replaceable plastic or metal sheet that is mounted to a door of the appliance by peripheral trim components.

In addition to mounting wood, plastic or metal panels to appliance doors, it also known to employ glass panels. Typically, a glass panel is secured to an appliance through trim pieces in a manner similar to that employed with plastic and metal panels. That is, each trim piece includes a first section that is secured to the appliance door with, for example, a mechanical fastener, and a second section that extends over side and front surfaces of the glass panel. While effective at holding the glass panel on the door, the trim piece visibly detracts from an overall aesthetic appearance of the appliance. More specifically, experience has shown that many consumers prefer appliances that have a smooth or seamless appearance. In order to obtain such an appearance, manufactures have employed various techniques to secure glass panels to appliances.

For example, as described in U.S. Patent Application Publication No. 2004/0183413, an external decorating member formed from glass is covered on one side with a layer of paint and then installed on a door of an appliance with adhesive. The glass panel is mounted in such a way so that the layer of paint is in continuous, direct contact with a front surface of the door to prevent the layer of paint from being scratched. While this method results in a somewhat seamless appearance, once installed, the glass panel cannot be removed without causing some damage either to the glass panel itself or the door. More importantly, mounting a glass panel in this fashion is considered to detract from the aesthetics provided by the glass. That is, the paint and adhesive generally make the glass panel appear like a metal panel.

In another example, as described in U.S. Pat. No. 6,854,458, a glass front panel is secured to an inner glass panel with angled retaining elements and a peripheral seal. The angled retaining elements are secured to both the inner glass panel and the glass front panel with adhesive. The peripheral seal is secured to the glass front panel and to a raised pan border portion of the inner glass panel. While this method also results in a somewhat seamless appearance, once installed, the glass front panel cannot be easily removed. If the glass panel is ever cracked or a different finish is desired, removing the panel from the appliance would prove difficult. Moreover, in order the maintain a peripheral seal, the inner glass panel must be specially molded to incorporate the raised pan border portion.

Based on the above, there still exists a need in the art for an enhanced decorative glass panel arrangement for a kitchen appliance. More specifically, there exists a need for a decorative glass panel that can be mounted in such a way so as to provide a seamless appearance, particularly with the structure used to mount the glass panel not being visible such that the glass panel appears to float relative to the appliance.

SUMMARY OF THE INVENTION

The present invention is directed to decorative glass panel assemblies for kitchen appliances and methods of attaching the same. The kitchen appliance includes a cabinet within which is arranged a compartment having a frontal opening. A door, hingedly supported by the cabinet, selectively covers the frontal opening to provide access to the compartment. In accordance with the invention, a glass panel assembly includes a glass panel and a plurality of spacers. The spacers are mounted to an outer surface of the appliance door and an inner surface of the glass panel. Preferably, the spacers are adhesively secured to the glass panel and are not visible when viewing the kitchen appliance from the front. Additionally, trim pieces fit between the glass panel and the appliance door, such that the spacers are not even visible when viewing the kitchen appliance from angled side views.

In accordance with another aspect of the invention, one or more side panels are attached to a top wall and/or opposing side walls of the cabinet by one or more spacers. For each side panel, one or more trim pieces fit between the side panel and the wall to which the panel is attached such that the spacers are not visible when viewing the kitchen appliance from the front or angled side views. With this construction, the glass panel appears to float relative to the door and the side panels appear to float relative to the cabinet walls.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
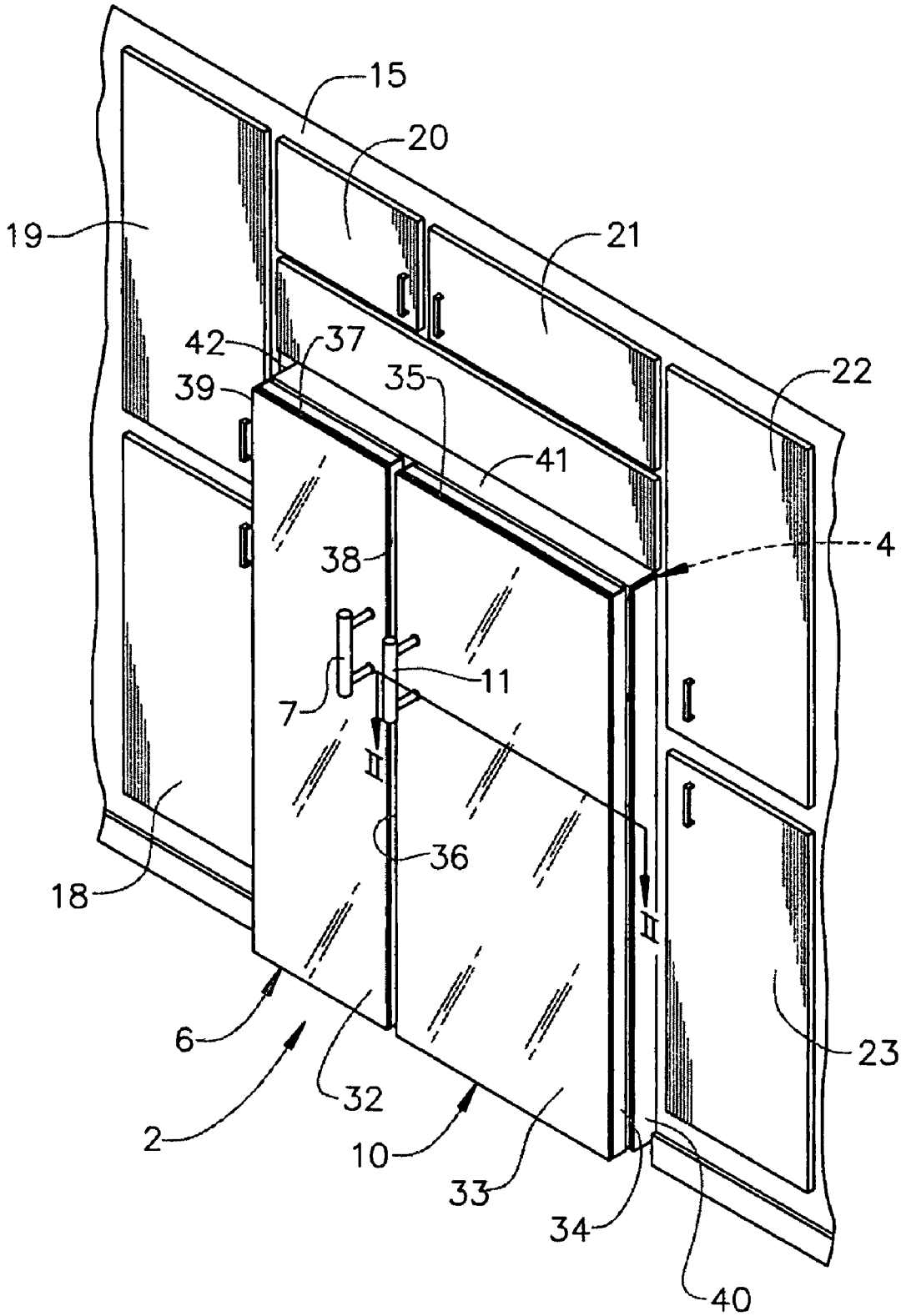
FIG. 1 is an upper right perspective view of a kitchen appliance including doors incorporating floating glass panels constructed in accordance with the present invention.

With initial reference to FIG. 1, a kitchen appliance, which is shown to be a refrigerator constructed in accordance with the present invention, is generally indicated at 2. Refrigerator 2 includes a cabinet 4 and is shown to include a freezer door 6, which is pivotally mounted to cabinet 4 and has an associated handle 7, and a fresh food door 10, which is also pivotally mounted to cabinet 4 and has an associated handle 11. In a manner known in the art, freezer and fresh food doors 6 and 10 selectively provide access to corresponding freezer and fresh food compartments (not shown). In the embodiment depicted, refrigerator 2 is of the recessed-type such that, essentially, only a small portion of refrigerator 2 projects forward of an associated wall 15, as well as a plurality of cabinets generally indicated at 18-23. It should be understood that refrigerator 2 could be arranged substantially flush with wall 15 and cabinets 18-23, may be bordered by cabinets only on one side, or even free-standing.

Figure 2:
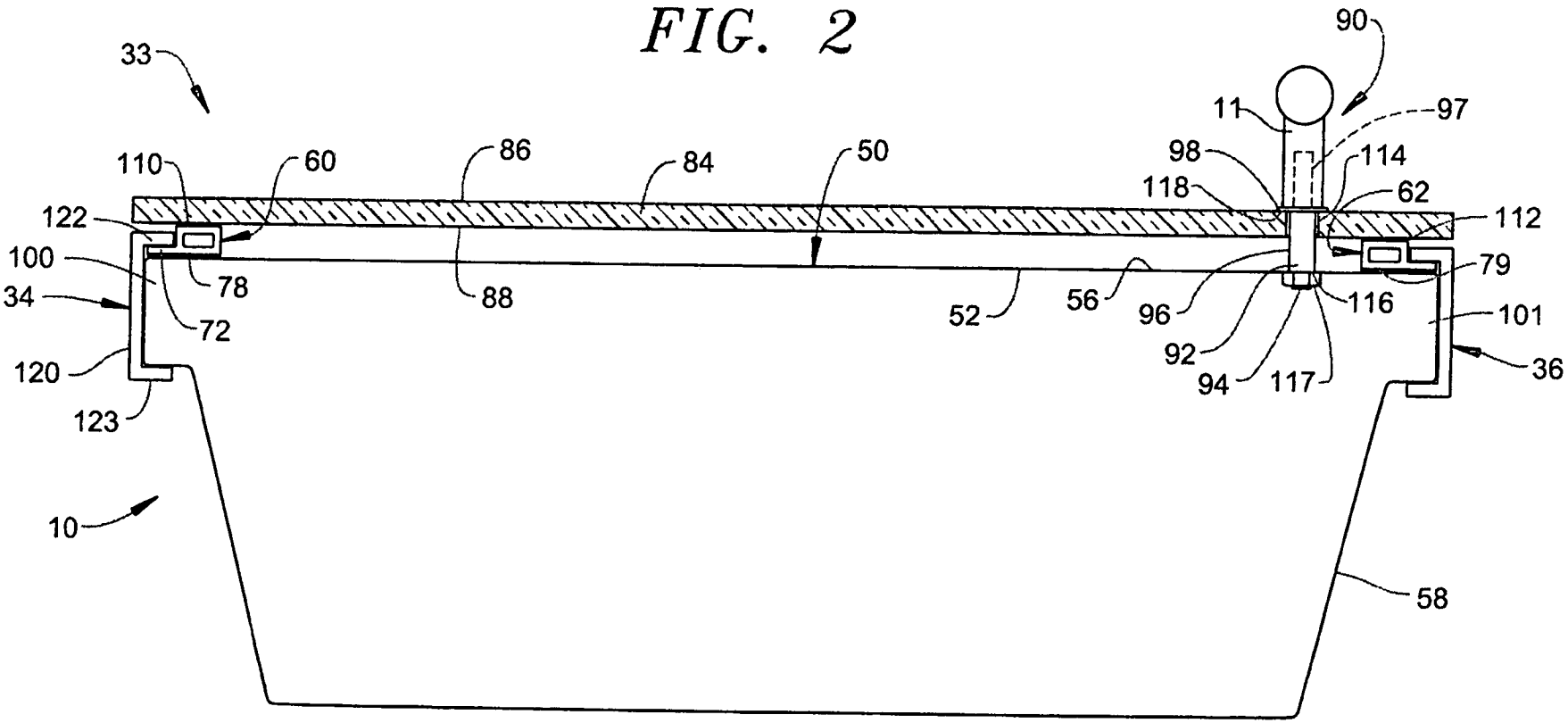
FIG. 2 is a cross-sectional view of one of the doors of FIG. 1 illustrating the mounting of the glass panel, as well as a handle, to the door.

In accordance with the present invention, glass panel assemblies 32 and 33 are mounted to freezer and fresh food doors 6 and 10, respectively. Preferably, glass panel assemblies 32 and 33 comprise smoked, etched or colored glass which is at least somewhat opaque and cannot readily be seen through. In accordance with the preferred embodiment of the present invention, glass panel assemblies 32 and 33 are mounted to doors 6 and 10 in such a manner so as to appear to float relative to refrigerator 2. More specifically, glass panel assemblies 32 and 33 are mounted to and spaced from respective doors 6 and 10 such that no mounting hardware is visible when viewing refrigerator 2 from front or side angled views in a manner that will be detailed more fully below. Additionally, as seen in FIGS. 1 and 2, freezer and fresh food doors 6 and 10 include a plurality of peripheral trim pieces 34-39. Although trim pieces 34-39 are shown in FIGS. 1 and 2, it should be understood that additional trim pieces (not shown) may be attached to doors 6 and 10 to provide a desired, aesthetically appealing and seamless appearance for refrigerator 2. As will be detailed more fully below, cabinet 4 can also include decorative glass side and top panel assemblies as indicated at 40-42.

Figure 3:
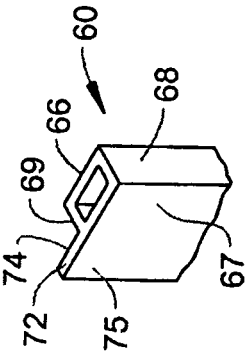
FIG. 3 is a perspective view of a portion of a spacer used in connection with the mounting arrangement of FIG. 2.

At this point, it should be understood that each door 6 and 10 and glass panel assemblies 32 and 33 are similar in construction such that a detailed description will be made with respect to door 10 and glass panel assembly 33 with an understanding that door 6 and glass panel assembly 32 have corresponding structure. Referring to FIG. 2, door 10 includes a main body panel 50 having an inner surface 52 and an outer surface 56. A door liner 58 is mounted to main body panel 50 in a manner known in the art. Arranged about outer surface 56 are a plurality of first spacers, two of which are indicated at 60 and 62. At this point, it should be understood that each spacer 60, 62 is preferably identically constructed and, as shown best in FIG. 3, includes opposing front and back walls 66 and 67 and opposing first and second side walls 68 and 69. Spacer 60 also includes a flange portion 72 that extends from side wall 69. As shown, flange portion 72 includes a front surface 74 and a back surface 75. Preferably, spacers 60 and 62 are made of aluminum or other metal and are attached to outer surface 56 by very high bond (VHB) tape strips 78 and 79. A glass panel 84, which is also part of glass panel assembly 33, has an outer decorative surface 86 and an inner mounting surface 88. Glass panel 84 is mounted to door 10 via spacers 60 and 62 and preferably covers an entire length and breadth of door 10. A door handle assembly 90 is provided for door 10 and includes a handle 11, a stand-off 92, and a fastener 94. In the embodiment shown, stand-off 92 includes a mounting arm 96 that leads from fastener 94 to a stub arm 97 to which handle 11 is releasably secured. At glass panel 84, handle 11 is seated on a head member 98 which is preferably formed from an elastomeric or plastic material.

The preferred manner in which glass panel assembly 33 is mounted on door 10 will now be discussed with reference to FIG. 2. Initially, spacers 60 and 62 are positioned at respective opposing sides 100 and 101 of main body panel 50, with flange portions 72 being located at respective outer peripheral edge portions (not separately labeled) of main body panel 50. As stated above, spacers 60 and 62 are preferably fastened to inner mounting surface 88 with VHB strips 78 and 79 respectively. Alternatively, mechanical fasteners, such as screws or the like, may be used to attach spacers 60 and 62 to main body panel 50. At this point, it should be recognized that, while only two elongated spacers are shown, any desired number of spacers may be used. Next, glass panel 84 is then centered over door 10 and attached to spacers 60 and 62 via additional VBH strips 110 and 112 provided on front walls 66 of spacers 60 and 62, respectively. Alternatively, spacers 60 and 62 may first be mounted to glass panel 84 before centering panel 84 over door 10 and securing spacers 60 and 62 to door 10 via VBH strips 78 and 79. Regardless, when mounted, at least walls 66, 68 and 69 of spacers 60 and 62 will be spaced inward from outer edge sections (not separately labeled) of main body panel 50. When centered on door 10, a first aperture 114 in glass panel 84 will be aligned with a second aperture 116 in main body panel 50. Mounting arm 96 of stand-off 92 is placed through aperture 114, with fastener 94 extending through aperture 116. A nut 117 is then threaded onto fastener 94 to fix stand-off 92 in position.

At this point, it should be realized that nut 117 could actually be pre-fixed to inner surface 52 about aperture 116 or inner surface 52 simply formed with a threaded aperture. In addition, it should be realized that a wide variety of different fastening, and even overall handle arrangements, could be employed. In any case, when secured to door 10, a back face 118 of head member 98 is substantially flush against decorative surface 86. Handle 11 may then be slipped over and secured to stub arm 97 with a set screw (not shown) or in any other conventional manner. Importantly, fixing handle 11 to stand-off 92 allows forces applied to handle 11 to transfer to stand-off 92, and hence to door 10. In this manner, no direct force is applied to glass panel 84 via handle 11 when opening and/or closing door 10. Once glass panel 84 is properly mounted to door 10, door liner 58 may be attached to main body panel 50, and the internal space of door 10 filled with insulating foam in a manner well known in the art. Again, a similar assembly is employed for door 6.

In addition to the above, first and second trim pieces 34 and 36 are preferably mounted on respective opposing sides (not separately labeled) of door 10, such as by mechanical fasteners (not shown). More specifically, trim panel 34 has a substantially U-shaped cross section having a front wall 120 and first and second opposing side walls 122 and 123. As can be seen in FIG. 2, first opposing side wall 122 is positioned between mounting surface 88 of glass panel 84 and front surface 74 of flange portion 72 on spacer 60. Front wall 120 extends across and covers side 100 of main body panel 50. At this point, it should be understood that trim panel 36 is attached to opposing side 101 of main body panel 50 in a like manner such that door 10 is provided with a finished appearance. More specifically, trim panels 34 and 36 are positioned such that respective spacers 78 and 79 are not visible when viewing the kitchen appliance from the front or angled side views. In addition, gaps (not labeled) are purposefully created between trim panels 34, 36 and inner mounting surface 88 of glass panel 84. With this construction, glass panel 84 appears to float relative to door 10.

Figure 4:
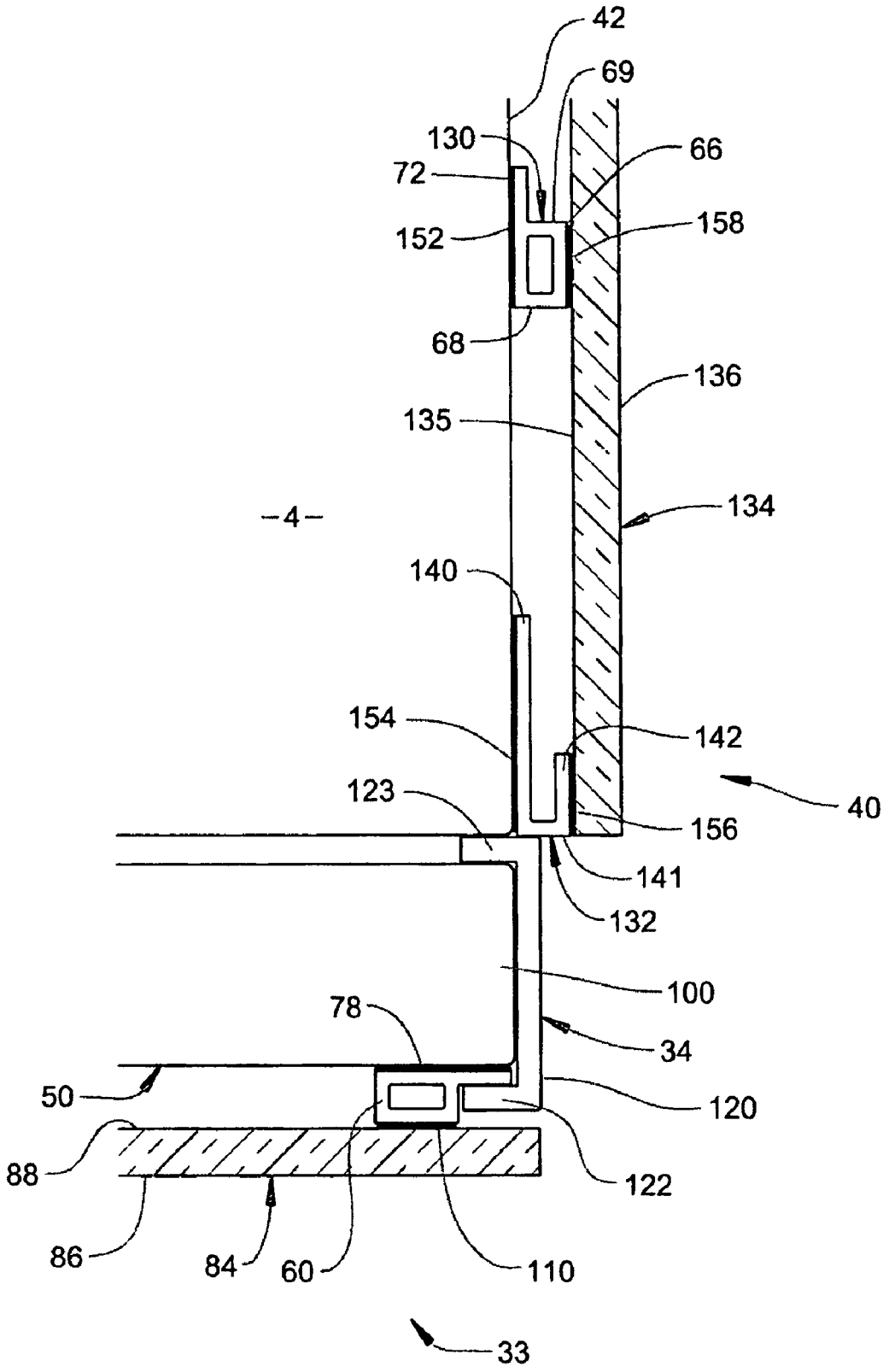
FIG. 4 is a partial top plan view of the kitchen appliance of FIG. 1 illustrating the mounting of front and side glass panels to the kitchen appliance.
Figure 5:
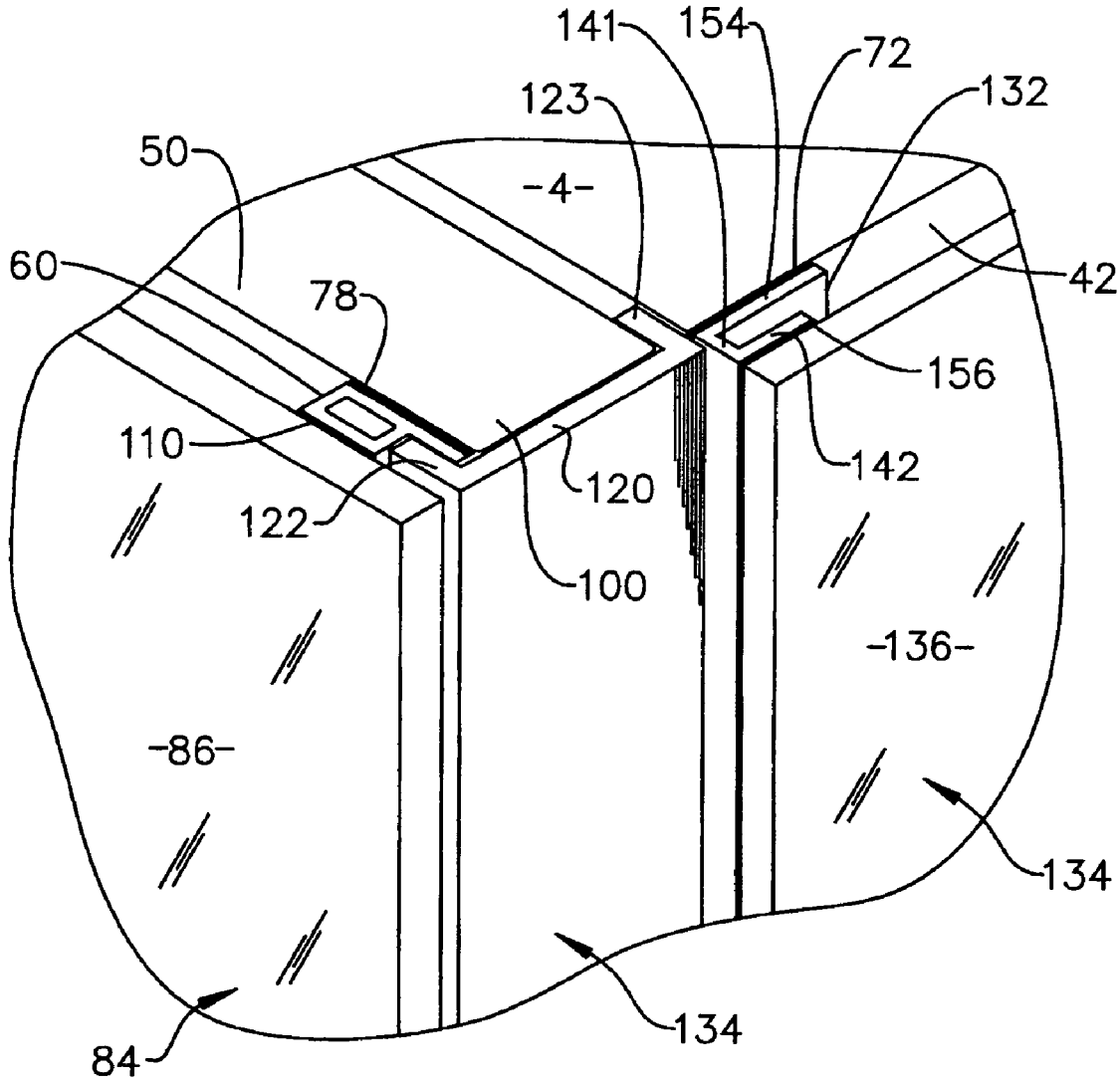
FIG. 5 is a partial perspective view of a front corner portion of the kitchen appliance of FIG. 4.

Reference will now be made to FIGS. 4 and 5 in describing a manner in which side panel assembly 40 may be attached to cabinet 4. Each side panel assembly 40, 41 is similarly constructed such that a detailed description will be made with respect to side panel assembly 40, with an understanding that side panel assembly 41 has corresponding structure. Side panel assembly 40 includes one or more side spacers 130, a side trim piece 132 and a glass side panel 134. Side panel 134 includes an inner surface 135 and an outer decorative surface 136. Side trim piece 132 has a substantially J-shaped cross-section including a first mounting portion 140, a side wall 141 and a second mounting portion 142. Side spacer 130 is preferably constructed identical to spacers 60 and 61 so as to include a front wall 66, opposing first and second side walls 68 and 69, and flange portion 72.

In order to mount side panel assembly 40 on cabinet 4, at least one side spacer 130 is mounted to side wall 42 of cabinet 4 with a VBH strip 152. Alternatively, side spacer 130 may be mounted to cabinet 4 with mechanical fasteners, such as screws or the like (not shown). Likewise first mounting portion 140 of side trim piece 132 is preferably mounted to side wall 42 of cabinet 4 with a VBH strip 154. As shown, a VBH strip 156 is arranged on second mounting portion 142 of side trim piece 132 and a VBH strip 158 is arranged on front wall 66 of side spacer 130. At this point, side panel 134 is centered over side wall 42 of cabinet 4 and mounted thereto via VBH strips 156 and 158. Alternatively, side trim piece 132 and side spacer 130 can be mounted to side panel 134 prior to securing side trim piece 132 and side spacer 130 to cabinet 4. It should be recognized that although FIG. 4 shows only one elongated side spacer 130, any desired number of individual side spacers 130 may be utilized to achieve a secure connection between glass side panel 134 and cabinet 4.

Based on the above, it should be readily apparent that the present invention enables a glass panel to be advantageously supported on a refrigerator door in such a manner that provides an aesthetically pleasing appearance mainly achieved by the overall mounting arrangement that makes the mounting hardware not visible while a gap is provided between the glass panel and the side trim, thereby creating an illusion that the glass panel floats relative to the door. In addition, the mounting arrangement does enable the glass panel to be removed, if needed, without causing damage to either the door or the glass panel itself. Although described with reference to preferred embodiments of the invention, it should be readily understood that various changes and/or modifications can be made to the invention without departing from the spirit thereof. For example, while described in connection with a refrigerator, it should be understood that the present invention could also be employed with other appliances, such as dishwasher, trash compactors, and the like. In addition, it should be recognized that the glass panel mounting arrangement could readily be employed in a retrofit manner, i.e., the glass panel mounted to an already assembled door by removing the existing handle, mounting the glass panel as set forth above, and then installing either the prior handle or another handle. In general, the invention is only intended to be limited by the scope of the following claims.

We claim:

1. A kitchen appliance comprising:

a compartment with a frontal opening;

a door supported for selectively closing the frontal opening, said door including a main body panel having an inner surface, an outer surface and opposing sides; and a decorative front panel assembly including:

at least one spacer including spaced front and back walls, said at least one spacer being secured to the outer surface of the door through the back wall;

a decorative glass panel mounted to the door through the at least one spacer, said glass panel having an outer surface and an inner surface, said inner surface being secured to the front wall of the at least one spacer while being spaced from the outer surface of the door; and a trim piece having a front wall and a side wall, the front wall extending across one of the opposing sides of the door and said side wall extending between the inner surface of the glass panel and the outer surface of the door while being spaced from the inner surface of the glass panel so as to define a gap between the side wall of the trim piece and the inner surface of the glass panel, wherein the at least one spacer is not visible from front or angled views and the gap creates an illusion that the glass panel floats relative to the door.

2. The kitchen appliance according to claim 1, wherein the at least one spacer includes first and second side walls extending between and interconnecting the front and back walls.

3. The kitchen appliance according to claim 2, wherein the at least one spacer includes a flange projecting from the back wall.

4. The kitchen appliance according to claim 3, wherein the flange extends to an outer peripheral edge of the outer surface of the door.

5. The kitchen appliance according to claim 4, wherein the side wall of the trim piece overlaps the flange.

6. The kitchen appliance according to claim 1, wherein the at least one spacer is adhesively secured to the outer surface of the door with double sided tape.

7. The kitchen appliance according to claim 6, wherein the glass panel is adhesively secured to the at least one spacer with double sided tape.

8. The kitchen appliance according to claim 1, wherein the kitchen appliance constitutes a refrigerator.

9. The kitchen appliance according to claim 8, wherein the glass panel covers the outer surface of the door.

10. The kitchen appliance according to claim 1, further comprising:

a cabinet including first and second opposing side walls having corresponding first and second side outer surfaces, and a top wall having a top outer surface, said compartment being located in the cabinet; and a decorative side panel assembly mounted to at least one of the first and second opposing side walls and the top wall, said decorative side panel assembly including:

at least one side spacer having spaced front and back walls, said back wall being mounted to one of the first and second side outer surfaces and the top outer surface; and a decorative side glass panel mounted to the at least one of the first and second opposing side walls and the top wall through the at least one side spacer, said side glass panel having an outer surface and an inner surface.

11. The kitchen appliance according to claim 10, wherein the decorative side panel assembly further includes a side trim piece having a side wall that extends an entire distance between a frontal edge portion of the side glass panel and the one of the first and second side outer surfaces and the top outer surface.

12. The kitchen appliance according to claim 11, wherein the side trim piece has a substantially J-shaped cross-section including a first mounting portion and a second mounted portion interconnected by the side wall.

13. A kitchen appliance comprising:

a compartment with a frontal opening;

a door supported for selectively closing the frontal opening, said door including an inner surface and an outer surface; and a decorative front panel assembly including:

at least one spacer including spaced front and back walls, said at least one spacer being secured to the outer surface of the door through the back wall;

a decorative glass panel mounted to the door through the at least one spacer, said glass panel having an outer surface and an inner surface, said inner surface being secured to the front wall of the at least one spacer while being spaced from the outer surface of the door;

a handle assembly secured to the door, said handle assembly including a stand-off that extends through the glass panel and is fixedly secured to the door; and a trim piece having a side wall that extends between the inner surface of the glass panel and the outer surface of the door while being spaced from the inner surface of the glass panel so as to define a gap between the side wall of the trim piece and the inner surface of the glass panel, wherein the at least one spacer is not visible from front or angled views and the gap creates an illusion that the glass panel floats relative to the door.

14. A method of mounting a decorative glass panel to an outer surface of a kitchen appliance door comprising:

securing at least one spacer to the outer surface of the door with a back wall of the at least one spacer being secured to the outer surface while being spaced inward from an outer peripheral edge of the door;

attaching an inner surface of a glass panel to a front wall of the at least one spacer with the front wall being spaced inward from an outer edge portion of the glass panel such that the glass panel is mounted to the door, while being spaced from the outer surface of the door, through the at least one spacer; and mounting a trim piece between the outer surface of the door and the inner surface of the glass panel so as to visually hide the at least one spacer, with a front wall portion of the trim piece extending across a side of the door and a side wall portion of the trim piece being spaced from the inner surface of the glass panel by a gap, wherein the at least one spacer is not visible from front or angled views and the gap creates an illusion that the glass panel floats relative to the door.

15. The method of claim 14, further comprising:

mounting the at least one spacer such that a flange extending from the back wall of the at least one spacer is positioned at the outer peripheral edge of the door; and mounting the trim piece with the side wall portion of the trim piece overlapping the flange while being spaced from the inner surface of the glass panel by the gap.

16. The method of claim 15, further comprising: mounting a door handle assembly to the door through the glass panel.

17. The method of claim 14, further comprising: adhesively attaching the glass panel to the at least one spacer.

18. The method of claim 17, further comprising: adhesively securing the at least one spacer to the outer surface of the door with double sided tape.

19. The method of claim 14, further comprising:

securing at least one side spacer to an outer surface of a kitchen appliance cabinet supporting the door with a back wall of the at least one side spacer being secured to the outer surface of the cabinet; and mounting a decorative side glass panel to the cabinet through the at least one side spacer, said side glass panel having an outer surface and an inner surface.

20. The method of claim 19, further comprising:

positioning a side trim piece between the cabinet and the side glass panel with the side trim piece extending an entire distance between a frontal edge portion of the side glass panel and the cabinet.

* * * * *